US005361618A

United States Patent [19]

Stefanelli

[11] Patent Number: 5,361,618

[45] Date of Patent: Nov. 8, 1994

[54] METHOD AND APPARATUS FOR ADJUSTING BENDING ROLLS

[75] Inventor: Joseph M. Stefanelli, McKees Rocks, Pa.

[73] Assignee: Italimpianti of America, Inc., Coraopolis, Pa.

[21] Appl. No.: 41,160

[22] Filed: Apr. 1, 1993

[51] Int. Cl.[5] ..... B21C 47/08; B21D 5/14

[52] U.S. Cl. ..... 72/174; 72/146; 72/169

[58] Field of Search ..... 72/173, 174, 146, 231, 72/169; 242/78.1, 78.6, 78

[56] References Cited

U.S. PATENT DOCUMENTS

| | | | |
|---|---|---|---|
| 2,450,041 | 9/1948 | Groves | 72/173 |
| 2,725,104 | 11/1955 | Wood | 72/148 |
| 2,937,821 | 5/1960 | O'Brien | 242/78.5 |
| 3,326,026 | 6/1967 | Guillot | 72/164 |
| 3,331,232 | 7/1967 | King | 72/365 |
| 4,005,830 | 2/1977 | Smith | 242/78.1 |
| 4,019,359 | 4/1977 | Smith | 72/231 |
| 4,232,540 | 11/1980 | Cain | 72/173 |
| 4,319,474 | 3/1982 | Gronbech | 72/229 |

FOREIGN PATENT DOCUMENTS

| | | | |
|---|---|---|---|
| 19361 | 11/1955 | Germany | 72/174 |

*Primary Examiner*—Daniel C. Crane
*Attorney, Agent, or Firm*—Webb Ziesenheim Bruening et al.

[57] ABSTRACT

A method and apparatus for adjusting a set of bending rolls which simultaneously position a pair of adjustable top bending rolls with respect to a bottom bending roll. A bottom bending roll is mounted within a housing while a pair of adjustable top bending rolls is mounted on a frame. A pivot shaft is rotatably mounted on the housing with eccentric portions of the pivot shaft coupled to the frame. Rotation of the pivot shaft causes the simultaneous adjustment of the pair of adjustable bending rolls with respect to the bottom bending roll.

14 Claims, 2 Drawing Sheets

METHOD AND APPARATUS FOR ADJUSTING BENDING ROLLS

BACKGROUND OF THE INVENTION

1. Field of the Invention

This invention relates to bending rolls, specifically for adjustable bending rolls utilized in coil boxes.

2. Prior Art

The coil box is a device used in hot strip mills to coil transfer bars, or strips, prior to entry of the strip into a finishing train. One of the most critical functions during the operation of a coil box is the initial coil formation, otherwise known as the first wrap. Early coil boxes possessed a sliding frame which located an upper pair of bending rolls for various strip thicknesses; setup adjustments of the set of bending rolls were performed by raising or lowering the upper bending roll frame. This adjusted both the two upper bending rolls equally and there was no provision for different adjustments of the individual upper bending rolls. Consequently, the location of the strip impact against a forming roll was based upon fixed geometry and could not be affected without altering the bending radius of the coil. The location of the impact against the forming roll is vitally important to properly form the first wrap.

FIG. 1 shows a more recent prior art set of bending rolls 10 for use in a coil box. The upper bending rolls 12 and 14 are mounted on a pivotable frame 16. The pivotable frame 16 allows for adjustment of the gaps 18 and 20 formed between the upper bending rolls 12 and 14 and a base bending roll 22. A main jackscrew 24 acting against a fixed stop 26 will pivot the main frame 16 about pivot point 28 to change gaps 18 and 20. However, the changes in gaps 18 and 20 are nonequal and nonlinear with this configuration, thus facilitating the need for differentially adjusting bending roll 14 with respect to bending roll 12. To provide for this fine adjustment, an auxiliary jackscrew 30 has been provided to allow for adjustments of upper roll 14 with respect to upper roll 12. The complex prior art arrangement also requires a pair of balance cylinders 32 (only one of which is shown in FIG. 1) and a hold-down cylinder 34 for proper operation.

The object of the present invention is to provide a simpler and more cost-effective method and apparatus for fine tuning the bending roll geometry which will provide appropriate setup for the initial coil formation.

SUMMARY OF THE INVENTION

The present invention provides a method and apparatus for adjusting a set of bending rolls for use in a coil box. The adjustable set of bending rolls includes a bottom bending roll rotatably mounted in a coil box housing, with a pair of adjustable top bending rolls rotatably mounted in a frame. Each of the adjustable top bending rolls defines a gap between itself and the bottom bending roll. A pivot shaft is rotatably mounted on the coil box housing with an eccentric portion of the pivot shaft coupled to the frame, wherein rotation of the pivot shaft causes adjustment of the pair of adjustable bending rolls and a corresponding changing of the size of each gap due to the eccentric portions of the shaft. A driving mechanism is provided for rotating the pivot shaft which may include a rotary position encoder.

The adjustable set of bending rolls of the present invention allows for the simultaneous positioning of the pair of adjustable top bending rolls with respect to the bottom bending roll by rotating the pivot shaft. Where a rotary positioned encoder is provided in the rotating mechanism, the simultaneous positioning of the pair of adjustable top bending rolls may be performed automatically by a process control computer.

The adjustable set of bending rolls of the present design allows for the elimination of sliding roll chocks, liners, auxiliary jackscrews and balance cylinders while still providing for differential adjustment of the adjustable bending rolls.

A complete understanding of the invention will be obtained from the following description when taken in connection with the accompanying drawings, wherein like reference characters identify like parts throughout.

DESCRIPTION OF THE PREFERRED EMBODIMENT

Figure 1:
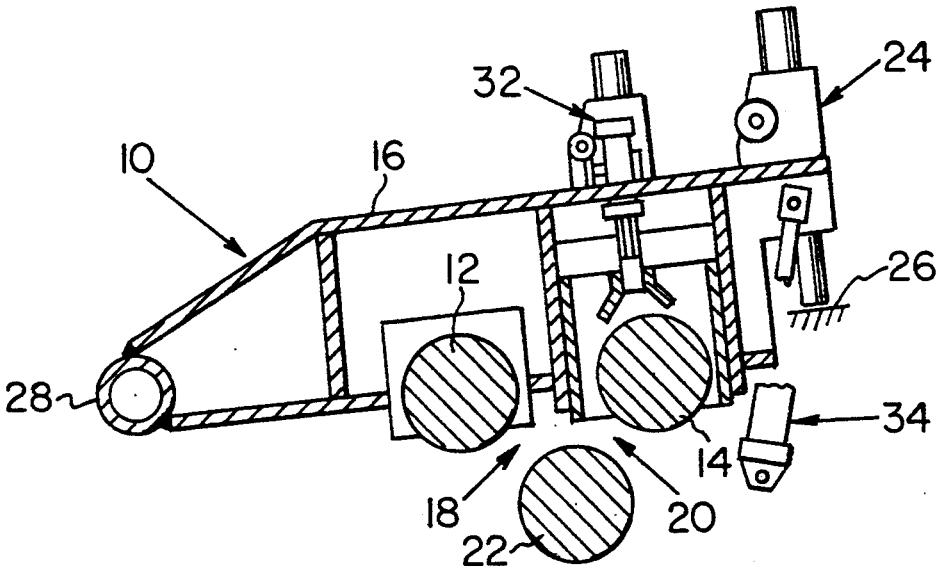
FIG. 1 PRIOR ART
FIG. 1 illustrates a section view of a known set of bending rolls.
Figure 2:
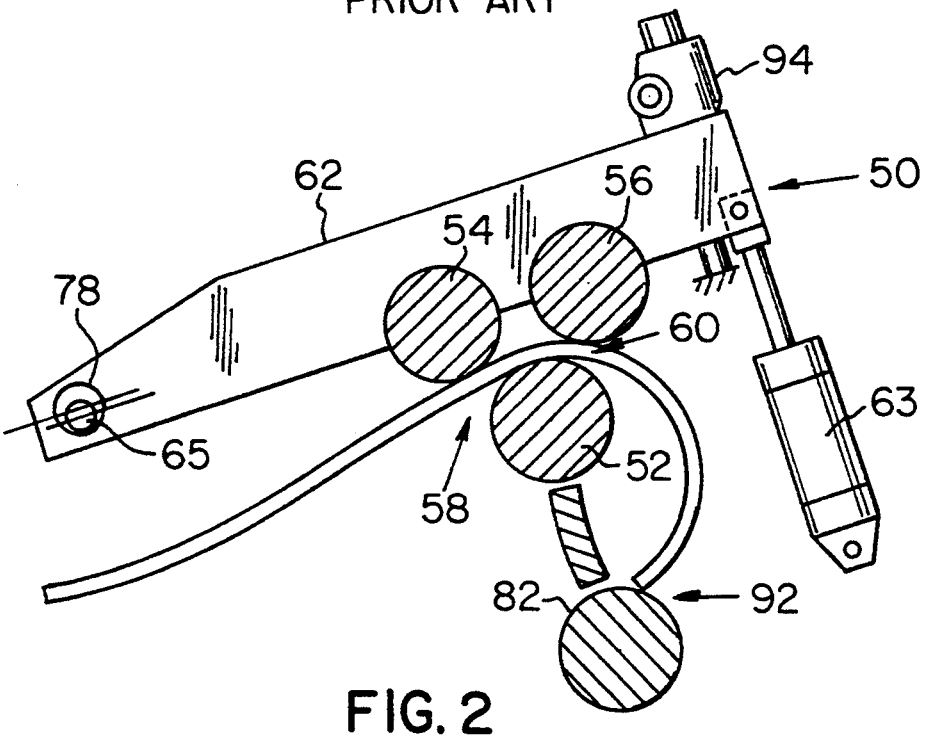
FIG. 2 illustrates a section view of an adjustable set of bending rolls of the present invention.

Referring to FIG. 2, an adjustable set of bending rolls 50 of the present invention for use with a coil box is illustrated. The adjustable set of bending rolls 50 includes a bottom bending roll 52 which is rotatably mounted in a coil box housing (not shown). A pair of adjustable top bending rolls 54 and 56 cooperate with the bottom bending roll 52 forming gaps 58 and 60 between each adjustable top bending roll 54 and 56, respectively, and the bottom bending roll 52. The adjustable bending rolls 54 and 56 are rotatably mounted on a frame 62. A hold-down cylinder 63 extends between one end of the frame 62 and the coil box housing. A pivot shaft 64 is rotatably mounted on the coil box housing with an eccentric portion 65 of the pivot shaft 64 coupled to the frame 62.

Figure 3:
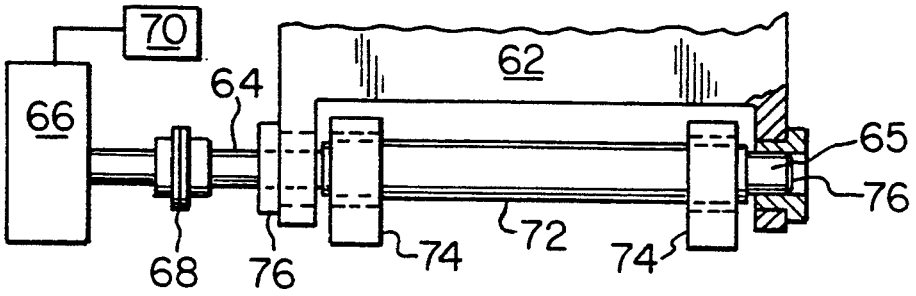
FIG. 3 is a top view of the top bending roll frame in the area of the pivot shaft shown in FIG. 2.
Figure 4:
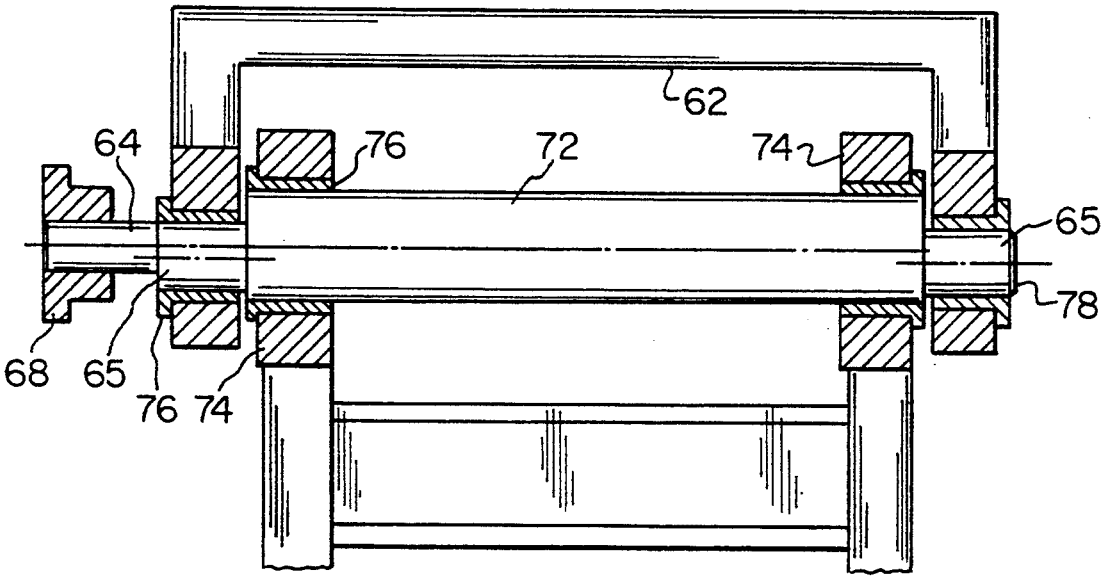
FIG. 4 is a section of the pivot shaft assembly shown in FIG. 2.

As shown in FIGS. 3 and 4, the pivot shaft 64 is rotatably driven by a drive system 66 through a coupling 68. The drive system can be any conventional electrical, mechanical, hydraulic or manual shaft drive system. The drive system 66 may include a rotary position encoder 70 to thereby provide a position feedback system. In this manner, the positioning of pivot shaft 64 may be performed automatically by a process control computer (not shown). As shown in FIG. 4, an enlarged portion 72 of shaft 64 has a centerline coincident with the axis of rotation of the shaft 64 and is supported on fixed supports 74 which include the appropriate bearings or bushings 76. Bushing members 78 provide the attachment between the eccentric portion 65 of shaft 64 and the frame 62.

Figure 5:
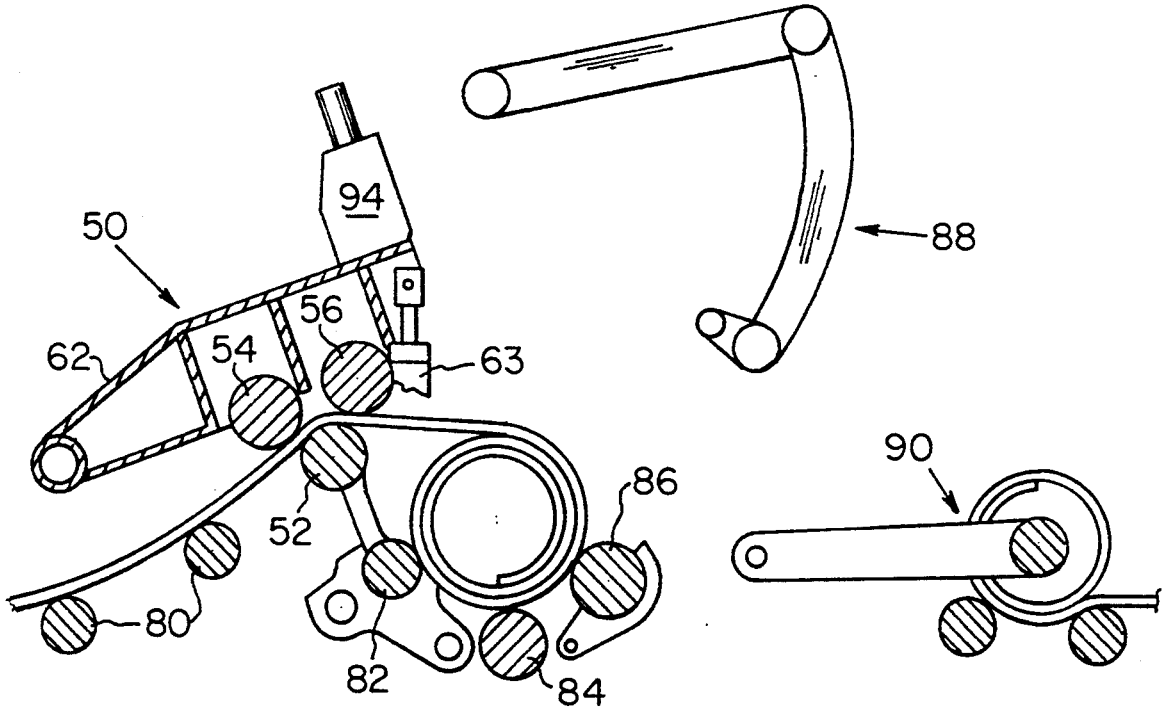
FIG. 5 is a schematic illustration of the adjustable set of bending rolls shown in FIG. 2 in use in a coil box.

FIG. 5 schematically illustrates the adjustable set of bending rolls 50 in operation. Table rollers 80 lead the strip to the bending rolls 52, 54 and 56. A forming roll 82 and cradle rolls 84 and 86 support the formed coil. A peeler arm 88 and coil transfer arm 90 are also provided.

Referring again to FIG. 2, the present arrangement provides a simple system for allowing for differential adjustment of the adjustable top bending rolls 54 and 56.

This differential adjustment allows for precise location of an impact location 92 of a strip being worked upon against the forming roll 82. This positioning of the impact location allows for the proper coil formation to occur. As illustrated in FIG. 2, a clockwise rotation of pivot shaft 64 will move the frame 62 toward the left. This will effectively increase gap 58 and decrease gap 60. The effect will cause a clockwise change in the position of the first coil wrap being formed. Conversely, a counterclockwise rotation of shaft 64 will result in a counterclockwise change in the initial wrap position as it leaves the bending rolls 52, 54 and 56.

The adjustable set of bending rolls of the present invention allows for simultaneous positioning of the pair of adjustable bending rolls with respect to the base bending roll by pivoting the pivot shaft. Attaching a rotary position encoder 70, otherwise known as a resolver, to the drive system 66 or to the shaft 64 itself allows a position feedback. In this manner, the setup adjustment may be performed automatically by a process control computer. This adjustment need only be made as an initial setup when changing the thickness of the transfer bar or strip being coiled. Adjustment of the bending radius as the coil builds up in size will be performed by a main gap adjustment mechanism 94.

An alternative embodiment of the present invention may be formed using a straight shaft which is rotated about an eccentric axis, that is, an axis of rotation offset from the centerline of the shaft. A floating drive system would be used to drive the eccentrically driven shaft and the fixed supports modified accordingly.

A specific embodiment of the invention has been described in detail herein, and it will be appreciated by those skilled in the art that various modifications and alternatives to the embodiment could be developed in light of the overall teachings of the disclosure. Accordingly, the particular arrangement is illustrative only and is not limiting as to the scope of the invention which is to be given the full breadth of the appended claims and any and all equivalents thereof.

I claim:

1. An adjustable set of bending rolls for forming a free standing coil, comprising:

a plurality of adjustable bending rolls;

a frame rotatably mounting said adjustable bending rolls;

a pivot shaft coupled to said frame having portions of said pivot shaft eccentric relative to an axis of rotation of said pivot shaft;

means for rotating said pivot shaft about said axis of rotation to adjust the position of said plurality of adjustable bending rolls;

a bottom bending roll rotatably mounted in a housing and cooperating with said plurality of said adjustable bending rolls wherein said rotation of said pivot shaft will adjust the position of said plurality of adjustable bending rolls with respect to said bottom bending roll; and a forming roll positioned to receive a leading edge of the free standing coil to be formed at an impact location on said forming roll to form at least an initial wrap of the free standing coil adjacent to said forming roll, wherein said adjustment of the position of said plurality of adjustable bending rolls relative to said bottom bending roll changes the location of said impact location on said forming roll in a corresponding change in the configuration of the initial wrap of the free standing coil.

2. The set of bending rolls of claim 1 wherein two adjustable bending rolls are provided.

3. The set of bending rolls of claim 1 wherein said housing is a coil box housing.

4. The set of bending rolls of claim 1 wherein said rotating means includes a rotary position encoder.

5. The set of bending rolls of claim 1 further including a plurality of cradle rolls configured to support the formed coil.

6. The set of bending rolls of claim 1 further including a main adjustment mechanism coupled to said frame configured to move said frame.

7. An adjustable set of bending rolls for use in a coil box for formation of a free standing coil, said set comprising:

a bottom bending roll rotatably mounted in a coil box housing;

a pair of adjustable bending rolls, with each said adjustable bending roll defining a gap between said adjustable bending roll and said bottom bending roll;

a frame rotatably mounting said adjustable bending rolls;

a pivot shaft rotatably mounted on said coil box housing with eccentric portions of said pivot shaft coupled to said frame;

wherein rotation of said pivot shaft causes adjustment of said pair of adjustable bending rolls and changing of the size of said gaps; and a forming roll positioned to receive a leading edge of the free standing coil to be formed at an impact location on said forming roll to form at least an initial wrap of the free standing coil adjacent to said forming roll, wherein said changing of the size of said gaps changes the location of said impact location on said forming roll in a corresponding change in the initial wrap of the free standing coil.

8. The set of bending rolls of claim 7 further including means for rotating said pivot shaft.

9. The set of bending rolls of claim 8 wherein said rotation means includes a rotary position encoder.

10. The set of bending rolls of claim 7 further including a plurality of cradle rolls configured to support the formed coil.

11. The set of bending rolls of claim 7 further including a main adjustment mechanism coupled to said frame configured to move said frame.

12. A method of adjusting a set of bending rolls in a coil box for proper formation of a free standing coil wherein said set of bending rolls includes a bottom bending roll rotatably mounted in a coil box housing, a pair of adjustable bending rolls, with each said adjustable bending roll defining a gap between said adjustable bending roll and said bottom bending roll, a frame rotatably mounting said adjustable bending rolls, and a pivot shaft rotatably mounted on said coil box housing with eccentric portions of said pivot shaft coupled to said frame, and a forming roll positioned to receive a leading edge of the free standing coil to be formed at an impact location on said forming roll to form at least an initial wrap of the free standing coil adjacent said forming roll;

said method comprising the step of:

rotating said pivot shaft to change the position of said impact location on said forming roll for proper formation of the initial wrap of the free standing coil, wherein rotation of said pivot shaft will simultaneously change both said gaps to change the position of said impact location.

13. The method of claim 12 further including means for rotating said pivot shaft, said rotating means including a rotary position encoder, said method including the step of automatically controlling said simultaneous positioning of said pair of adjustable bending rolls by a process control computer.

14. The method of claim 12 wherein said rotation of said pivot shaft further includes the step of increasing one of said pair of gaps while simultaneously decreasing the other of said pair of gaps.

* * * * *